US007752815B2

(12) United States Patent
Lauria et al.

(10) Patent No.: US 7,752,815 B2
(45) Date of Patent: Jul. 13, 2010

(54) STRUCTURE WITH MULTIPLE FUNCTIONS, USED AS A COVERING

(75) Inventors: Agostino Lauria, Sassari (IT); Massimiliano Lauria, Sassari (IT); Alessandro Lauria, Sassari (IT)

(73) Assignee: L.A.S.P. System Italia s.r.l., Sassari (IT)

( * ) Notice: Subject to any disclaimer, the term of this patent is extended or adjusted under 35 U.S.C. 154(b) by 1076 days.

(21) Appl. No.: 10/573,648

(22) PCT Filed: Aug. 1, 2005

(86) PCT No.: PCT/IT2005/000463

§ 371 (c)(1),
(2), (4) Date: Mar. 28, 2006

(87) PCT Pub. No.: WO2006/109338

PCT Pub. Date: Oct. 19, 2006

(65) Prior Publication Data

US 2008/0244989 A1 Oct. 9, 2008

(30) Foreign Application Priority Data

Apr. 14, 2005 (IT) ..... RM2005A0184

(51) Int. Cl.
*E04B 1/346* (2006.01)

(52) U.S. Cl. ..... 52/66; 52/6; 52/67

(58) Field of Classification Search ..... 52/66, 52/67, 64, 72, 6

See application file for complete search history.

(56) References Cited

U.S. PATENT DOCUMENTS 2,603,171 A * 7/1952 Smith ..... 52/66
3,815,299 A * 6/1974 Sorensen et al. ..... 52/66
4,175,361 A * 11/1979 Kumode ..... 52/66
4,616,451 A * 10/1986 Glick ..... 52/66
4,751,800 A * 6/1988 Kida et al. ..... 52/66
4,831,792 A * 5/1989 Berger ..... 52/66
5,778,603 A * 7/1998 Reppas ..... 52/66
6,042,094 A * 3/2000 Lee ..... 267/150
6,637,160 B2 * 10/2003 Brooks ..... 52/66
6,948,284 B2 * 9/2005 Chiang ..... 52/167.1
7,263,805 B2 * 9/2007 Chapus ..... 52/67

FOREIGN PATENT DOCUMENTS

| | | |
|---|---|---|
| DE | 197 44 001 | 4/1999 |
| EP | 0 147 502 | 7/1985 |
| EP | 1 314 829 | 5/2003 |
| FR | 2 788 291 | 7/2000 |

* cited by examiner

*Primary Examiner*—Basil Katcheves
(74) *Attorney, Agent, or Firm*—Young & Thompson

(57) ABSTRACT

A structure used as a covering and, having different functions, includes several section bars (700, 701, 101') preferably made of aluminum or generally of light metal, which form uprights (701) and horizontal support beams (101'; 700). The structure includes aseismatic elements (306; 307; 319) at the interconnection or branching points between the horizontal section bars (beams) and the vertical section bars (uprights), and at the base of the uprights. At these points there are also provided elements (2, 303, 304, 308) to promote the downflow of rainwater. The structure is equipped with at least one telescopic roof that may be transparent or not. Additional functions provided by the structure are the anti-wind function, the water drainage from the roof, the self-cleaning function used for automatically cleaning the, roof with water jets and scraping gaskets, etc.

20 Claims, 8 Drawing Sheets

STRUCTURE WITH MULTIPLE FUNCTIONS, USED AS A COVERING

TECHNICAL FIELD

The present invention generally relates to structures which are used as coverings and are made of metallic section bars, mostly of aluminium, and which can be quickly assembled and are light and resistant at the same time. The structures to which the present invention refers have various functions, and besides protecting from bad weather the people that are temporarily inside them, they also protect them from high and low temperatures and from noise. The main functions are certainly the aseismatic function and the "anti-wind", or wind protection function, since a structure of the present kind is capable of resisting to important seismic waves and to very strong gusts comparable to those generated by hurricanes.

A structure of this kind could be utilised for instance for the construction of swimming pools, factory sheds, structures as those used for exhibitions and/or meetings, or the like. Thus, it may be seen that its application field is very wide and therefore the present invention will not be limited in any particular way under this aspect.

A first object of the present invention is to realise a structure which mostly comprises metallic section bars capable of oscillating, by taking advantage of adequate shock absorbing systems and elastic or non elastic articulated joints, in order to "follow" the movements induced by the waves of an earthquake without causing any damage to the structure itself.

A second object is to provide an anti-wind system which is "yielding" and therefore allows small displacements of the structure in response to gusts, while permitting at the same time the passage of air through certain parts (of the structure) in order to insure that the drafts can find an outlet to the outside of the structure without endangering the stability of the structure itself.

A third object consists in providing appropriate drainage and downflow channels for meteoric waters.

A fourth object is to realise a telescopic system for opening and closing the top of the structure, comprising for instance a lower, transparent part and an upper, non-transparent part.

Therefore, in cold resorts it will be possible to open the non-transparent upper part of the structure and to take advantage of the "greenhouse effect" caused by the sunrays impinging on the transparent part of the covering which, in this case, will remain closed and will heat the inner space (example: a swimming pool in a mountain resort).

SUMMARY OF THE INVENTION

Some of the abovementioned objects are attained by the features contained in claim 1, while other, additional objects are attained by means of the features defined in the dependent claims. Some of the dependent claims relate to specific embodiments (for instance to particular realisations of the aseismatic means of the structure, as in claim 7).

The aseismatic means are inserted—according to the present invention—at the base (foot) of the uprights (which are preferably made of aluminium section bars), and at the interconnection or branching points between the uprights and the beams horizontal section bars preferably made of aluminium). Therefore, the structure is capable of oscillating in all directions.

According to claim 6 there are provided means for limiting the angle of oscillation of the uprights with respect to the base plane defined by the telescopic roofs. According to the following description these means may be formed by a rigid reticular structure which is laterally connected by articulated joints to the lateral support beams, and wherein these articulated joints have a maximum angle of oscillation (rotation) of e.g. 35°, which is defined by mechanical stops (abutment surfaces).

In accordance with claim 2 the structure also has an anti-wind function and to this purpose it includes anti-wind means of the following kind:

butterfly valves, formed by rotatable structurals which open and close respective holes or apertures provided on the telescopic roof;

rotation means that are mounted between a lateral edge of a telescopic roof and a plurality of lateral structurals, in such a way as to promote the lateral rolling of the covering (roof) in the eventuality of a strong wind, and in order to insure in this manner a certain degree of "yielding" of the covering in response to the gusts of the wind. These means, according to the detailed description which will follow, will preferably consist of mutually coupled (hinged) plates provided along the whole extension or length of the structure, along its longitudinal edges.

Preferably, according to the present invention the uprights have inner cavities both for reducing the weight and for insuring the downflow of the meteoric water from the roof. Also the lateral, longitudinal support beams of the structure are preferably open on their upper side for insuring the downflow of water towards the uprights.

The aseismatic means at the feet of the uprights are preferably lodged inside a container formed by a pair of plates ("double plate") which also receive an element used to collect rainwater from the uprights and to discharge the same to the ground, through apertures provided on the lower side (bottom) of the abovementioned container.

According to claims 11 and 12 the telescopic roofs may be transparent or non-transparent.

In all, a structure is obtained whose prerequisite is to insure safety in the eventuality of earthquakes and having a telescopic roof for optimising the drive system of the roof both under the aspect of the required space and of the functionality.

Moreover, the structure insures in the best possible way—after adding all the other features taken from the dependent claims—the safety of the people which stay under it; it also allows a rapid drainage of the water, it solves the problem of the cleanliness of the roof thereby reducing at the same time the service (maintenance) works for the roof, it allows a quick assembling of various parts of the structure, it is light (being preferably generally formed of aluminium structurals), it is suited for various places (desert land, mountain resorts, etc.), it can be thermally and acoustically insulated with respect to the outside environment, but it can also be used—for example—as a covering for outdoor swimming pools if lateral walls are omitted.

There exists a great number of possible applications for the structure according to the present invention. It can be used in all cases when it is required to rapidly install a resistant and safe structure capable of accomplishing at least some—or even all—of the above described tasks/functions.

It could be used as a factory shed, as a covering for shows, exhibitions, or other activities/meetings (e.g. for sport activities), particularly as a covering for (outdoor or indoor) swimming pools, or as a place for collecting people evacuated from a nearby seismic region, etc. The structure dimensions are adaptable to the needs of each particular circumstance. Consequently, the length of the support beams can be selected according to the particular needs, as may also be inferred from the following detailed description

BRIEF DESCRIPTION OF DRAWINGS

The present invention and its further objects and advantages will now be described for illustrative, but non-limitative and non-binding purposes, by referring to a specific embodiment thereof, which is shown in the attached drawings, wherein.

DESCRIPTION OF A PREFERRED EMBODIMENT

The present invention will now be described for illustrative purposes by referring to the various drawings.

Figure 1:
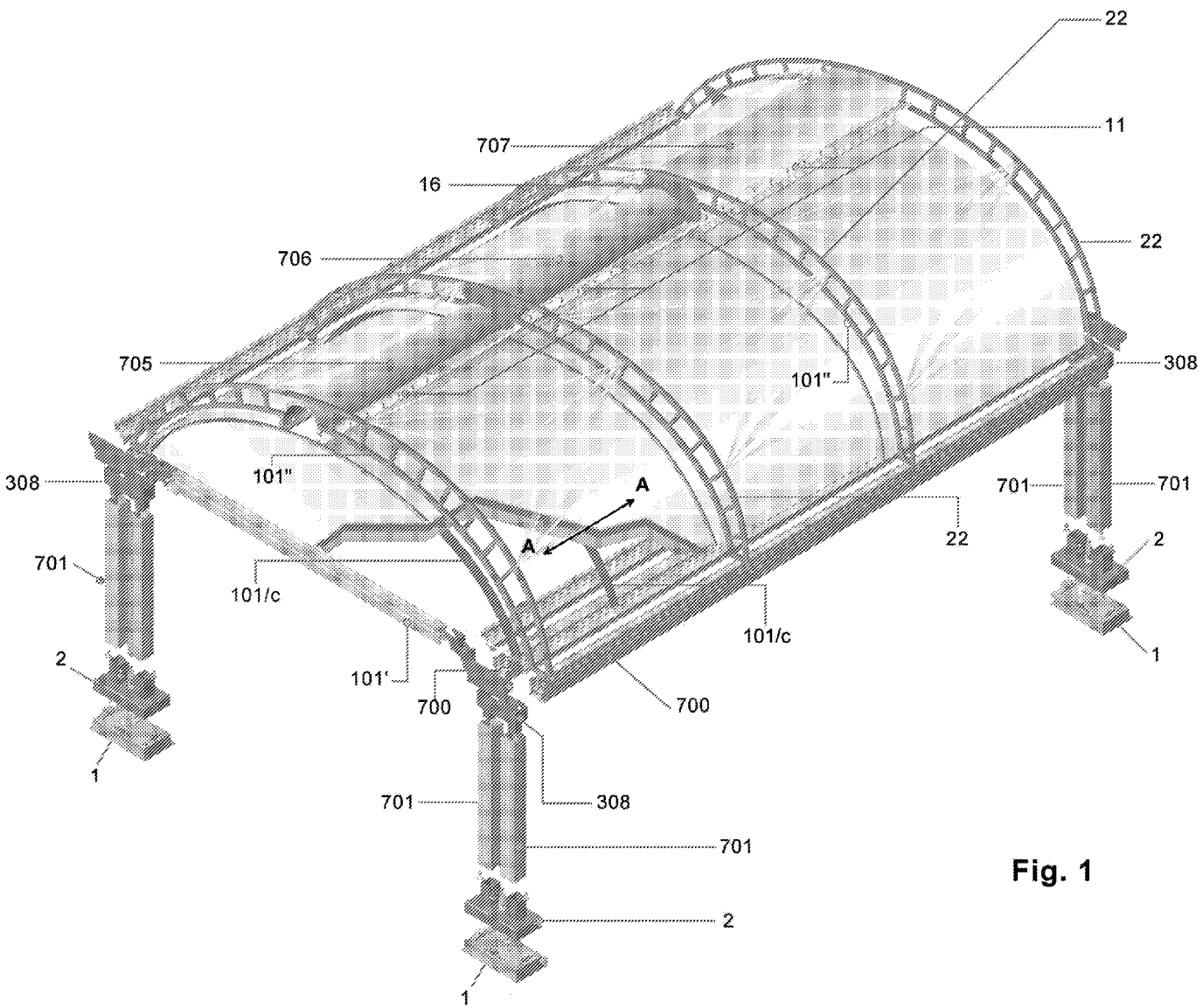
FIG. 1 is a general view of the structure according to the present invention.
Figure 2:
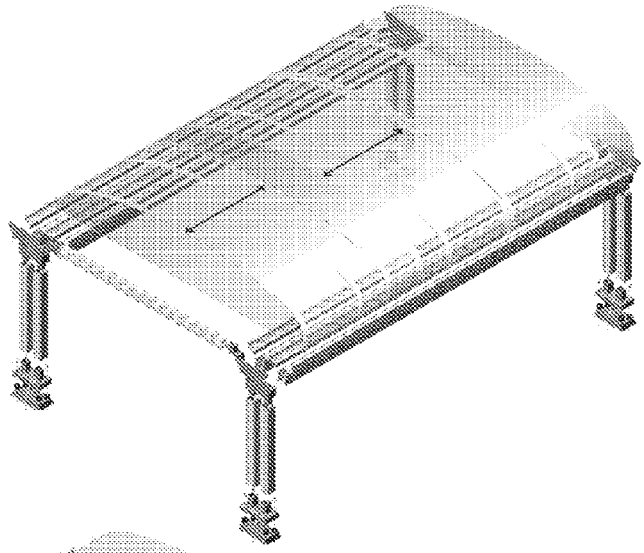
FIG. 2 shows the underlying part of the covering, made of transparent (e.g. plastic) material, in its nearly closed condition.
Figure 3:
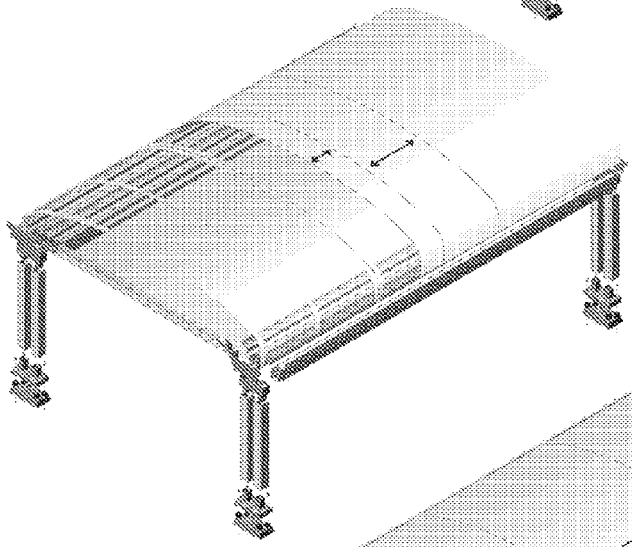
FIG. 3 shows the upper, not transparent part of the covering, in a partially closed condition, and the completely closed underlying (or lower) transparent part of the covering (note the telescopic opening/closing system very schematically indicated by the double arrows)
Figure 4:
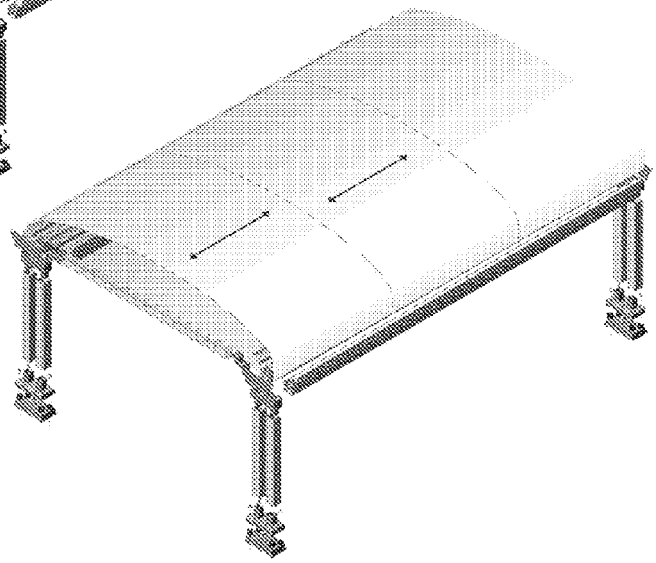
FIG. 4 shows the upper part of the covering in the completely closed condition over the lower part of the covering.

Considering FIG. 1 first, it shows a multipurpose structure in accordance with the present invention, including light section bars that are preferably made of aluminium. In this structure, all components (fittings) and all section bars are easily and rapidly assembled.

Figure 7:
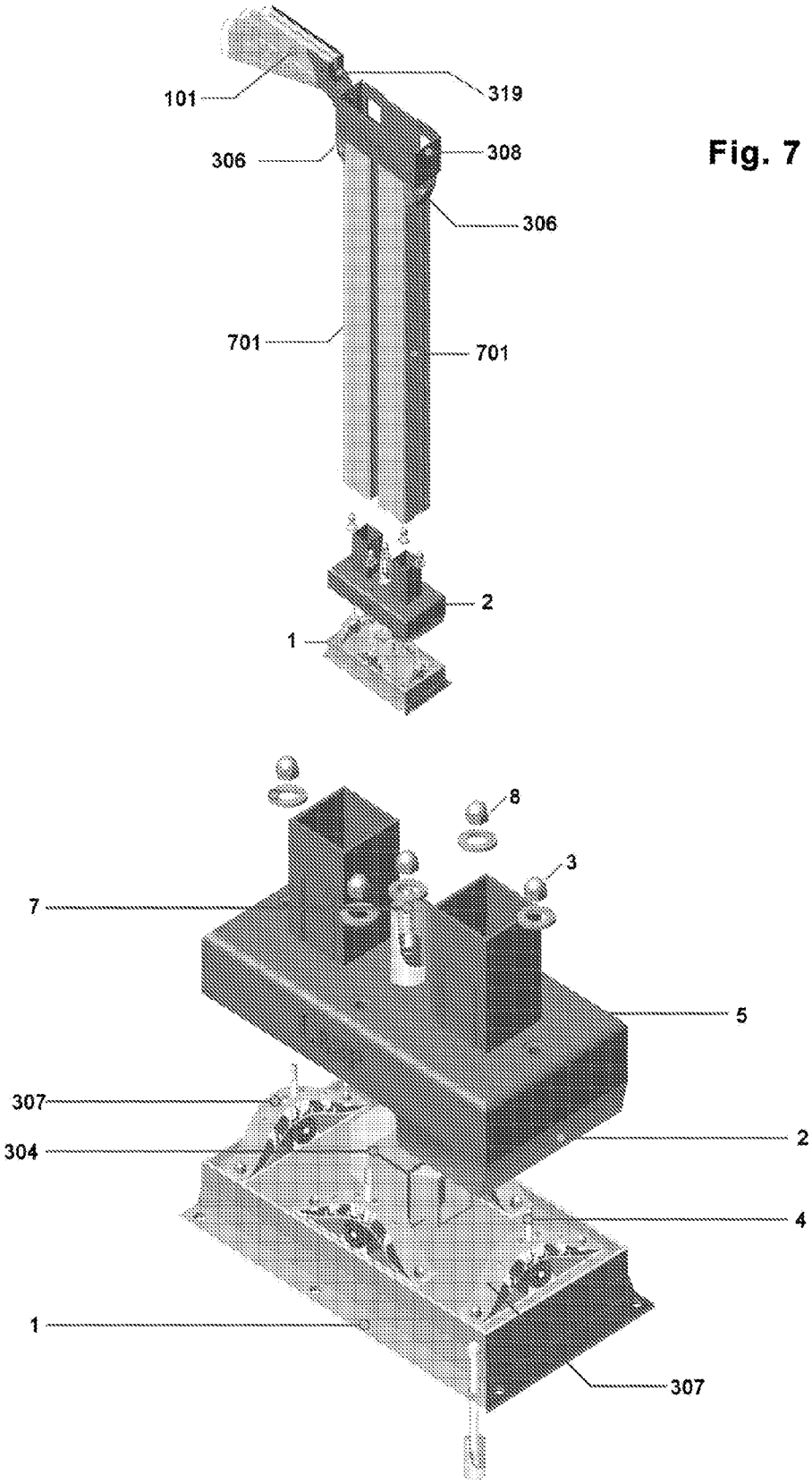
FIG. 7 shows in detail the shock absorber system (aseismatic system) relative to the lateral uprights.
Figure 8:
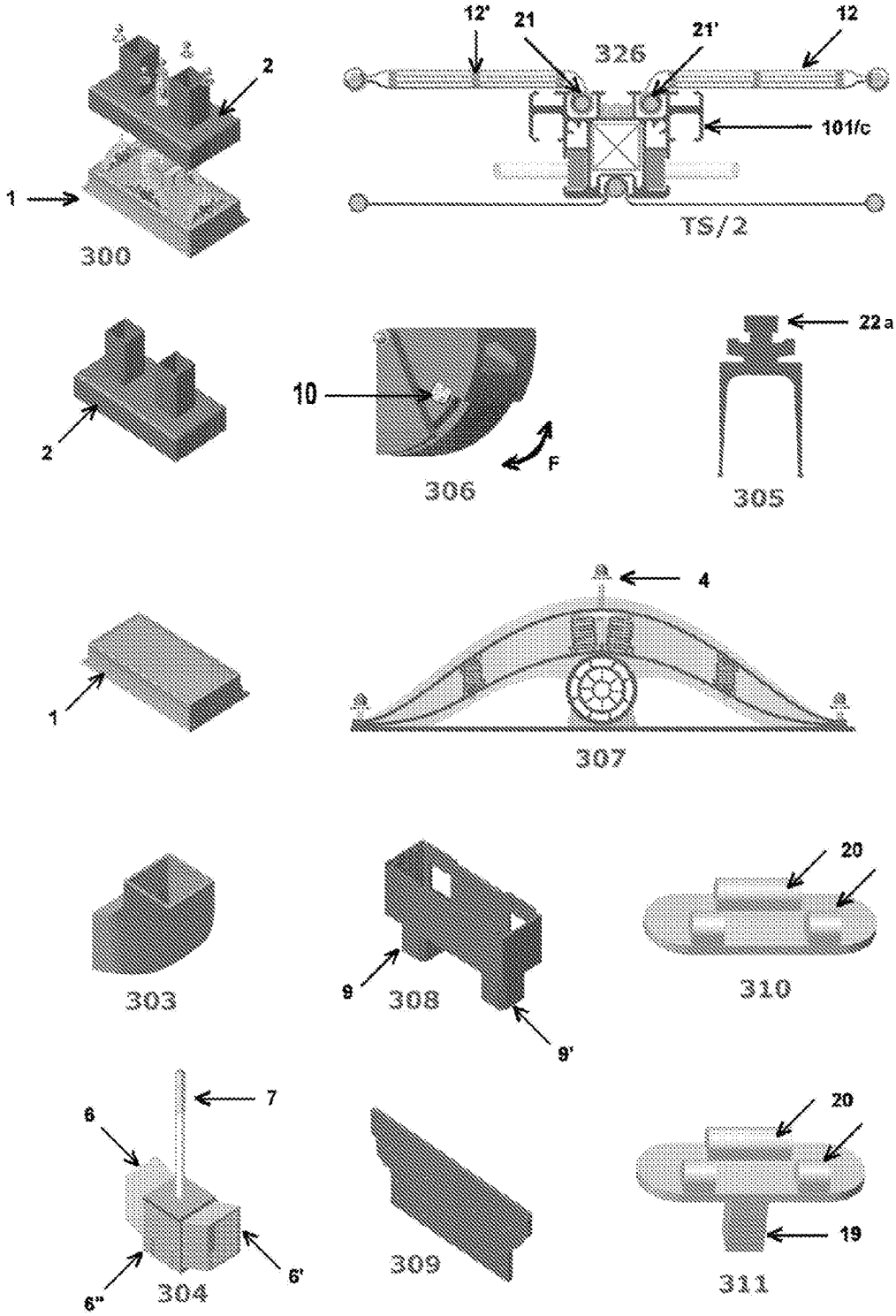
FIG. 8 shows a plurality of components, some of which are already included in other figures, as in FIG. 7, although in a less detailed manner; the functions of these components or fittings will be thoroughly discussed in the following detailed description.

The structure comprises, at the four "feet" of respective vertical uprights, two pre-formed plates 1, 2 of die-cast aluminium, which are mutually fitted into each other and which have the function of containing four shock absorbers inside apposite pre-formed joints (see FIG. 7, reference 307, wherein 307 denotes only one of the four identical shock absorbers; see also FIG. 8 in which a longitudinal section is taken of one of the four members 307 arranged at the four sides of the assembly 300 formed by these two plates 1, 2).

Each shock absorbing member (shock absorber) 307 is made of a shaped body of EPDM, fixed to two leaf springs of high-quality high-carbon steel (steel wire) with progressive deformation and also fixed to interposed helical springs allowing in turn flexibility and oscillations in all directions. It may be seen, therefore, that the upper plate 2 is capable of rocking in all directions with respect to the underlying plate 1. The details of the assembling of plate 2 to the underlying plate 1 are shown in FIG. 7, lower part; there, the cap nut 3, for instance, is screwed on a threaded shaft 4 (integral to 307) which passes through a hole 5 of plate 2. A similar connection applies to the remaining shock absorbers 307. Note that, according to a usual practice in the patent field, only some reference signs for these identical components have been included in order to simplify the drawing; for instance, only two shock absorbers have been indicated by their reference number 307 in FIG. 7, although their total number is obviously four, in accordance with the above description.

Figure 10:
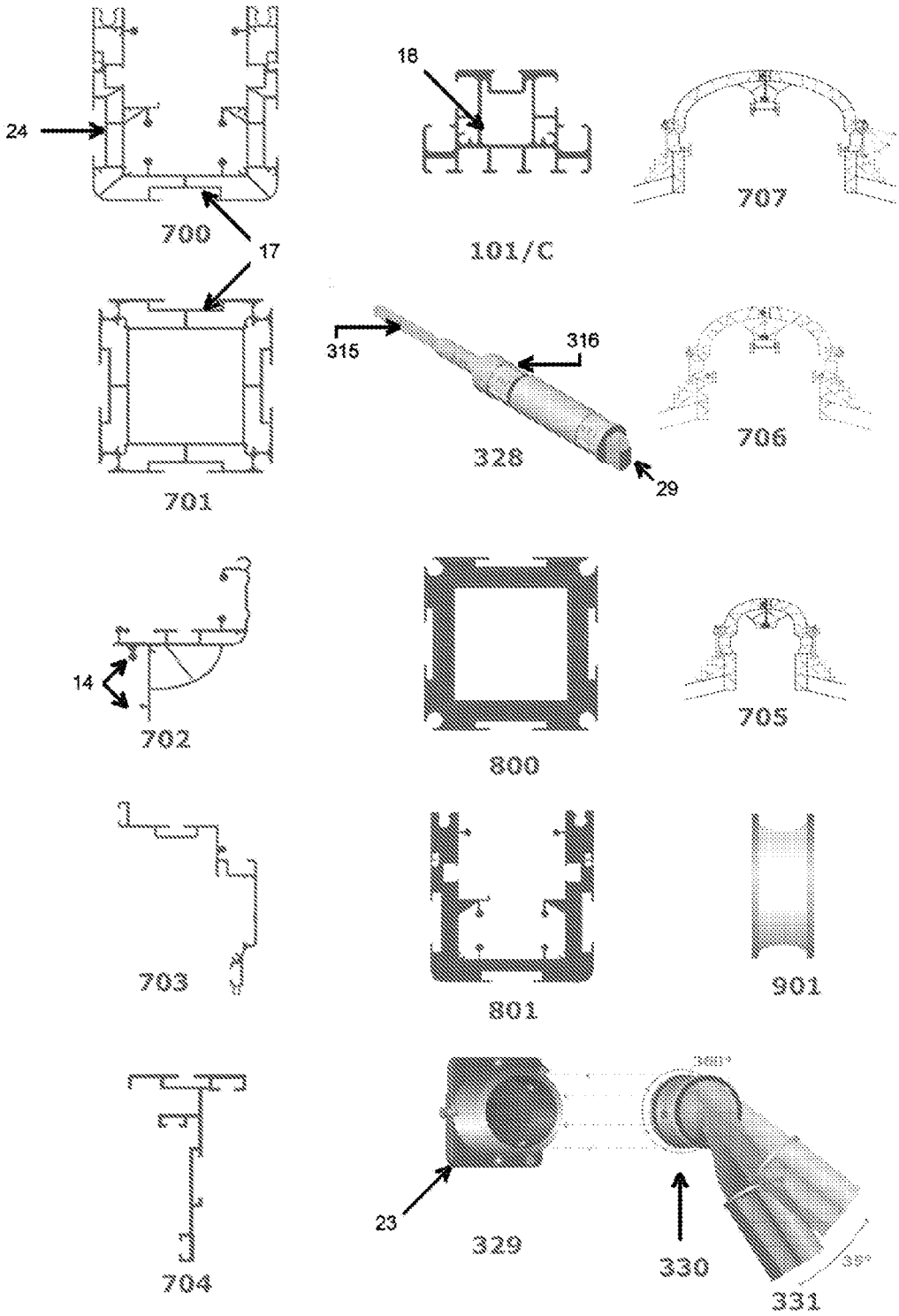
FIG. 10 shows the cross sections of some of the section bars of the structure (some of which are included in the telescopic covering system), the gaskets (seals), a pulley, and a safety system for limiting the maximum angle of oscillation of the top of the structure.

Moreover, FIG. 7 shows that each upright (of the four structure uprights) includes two disjoint, parallel section bars 701, whose cross section is clearly depicted in FIG. 10. Two sleeves, made integral with the plate, having a square cross-sectional shape, and extending from the upper side of this plate 2, receive the two section bars 701. An integrally formed element 304 is provided at the center of the lower plate 1, this element being shown isolated in FIG. 8 and being formed by a single V-shaped piece of die-cast aluminium; it allows to collect the water flowing vertically downwards within the two section bars 701 of each vertical upright (see the description below). The water is guided (drained) to the ground through the section bars 701, and then it passes through two elastic, bellows-like pipe fittings, as the one indicated by 303 in FIG. 8. In other words, the two bellows-like elements 303 are connected on one side to the lower apertures of the hollow section bars 701 that are in turn inserted on the square sleeves of the upper plate 2, and on the opposite side they are connected to the respective inlet or mouth 6, 6' of the element 304 which is internally hollow and has a lower, square-shaped drainage aperture 6". Obviously, in the region of this latter aperture 6", the box-shaped lower plate 1 is open in order to permit the downflow of meteoric water, or of the water used for washing the structure (see description below).

Moreover, the "feet" of the four vertical uprights also include a safety system, comprising a threaded stem (reference numeral 7 of element 304, FIG. 8) which passes through a bore of greater diameter (located on the upper side of plate 2) and receives a coaxially mounted helical spring (see FIG. 7), the latter being retained by a nut 8 screwed on said stem 7 and abutting the plate 2 at its lower end. This safety system becomes important in case of earthquakes of greater magnitudes, in which case the two plates 1, 2 could tend to part.

In the upper part, the two section bars 701 are inserted with a certain play, that is loosely, on two square sleeves 9, 9' of the component 308 (see FIG. 8 and FIG. 7, in particular). The component 308 is formed of an integral piece of die-cast aluminium, acting like a double drainage means of the rainwater, and it is connected to horizontal section bars 700 (see. FIGS. 1 and 8). In FIG. 7, upper part, it may be seen that on the upper end of the section bars 701 there are connected two components 306 (see also FIG. 8); the details of this connection being irrelevant for our purposes); these two components are provided with a respective internal spring 10 allowing a compression and an expansion of each component 306, as indicated by the double arrow F. Analogously, between two section bars 700 (see FIG. 1) provided on each "long" side of the structure according to the invention, on the one hand, and each component 308, on the other, there are inserted once again two respective elements 306 (not shown), which also have the function of absorbing the tremors of an earthquake at each upper angle of the structure. In FIG. 1 it seems that the ends of the section bars 700 are separated from the component 308; obviously, this does not occur in reality after the structure has been totally assembled and only serves to facilitate the understanding of FIG. 1.

Therefore, at each of the four upper angles there are—in all—four shock absorber elements 306.

FIG. 7 (upper part) also includes an articulated-joint device, which has as well a shock absorbing function. The component 319 (which is individually shown in FIG. 9) is rigidly connected to the component 308 and has a hinge for realising an articulated joint with the section bar 101, the latter being different from the section bar 101/C (FIG. 8) to be described later on. The cross section of section bar 101 has been disclosed in another patent application of the same applicant.

Obviously, the shock absorbing system used for dampening the vibrations, which has been disclosed above, is the same for each of the four angles of the structure.

Next, referring in general to FIGS. 1, 2, 3 and 4, and more specifically to FIGS. 5, 6 and FIG. 8 (see detail shown at the right upper corner and indicated by numeral 326), a description will be given of the telescopic system used as a drive means of the covering. Since this system is the same both for the transparent part of the covering (single layer) and for the non-transparent part of the covering (which includes four layers), only the telescopic drive system used to displace the non-transparent covering will be discussed.

Figure 5:
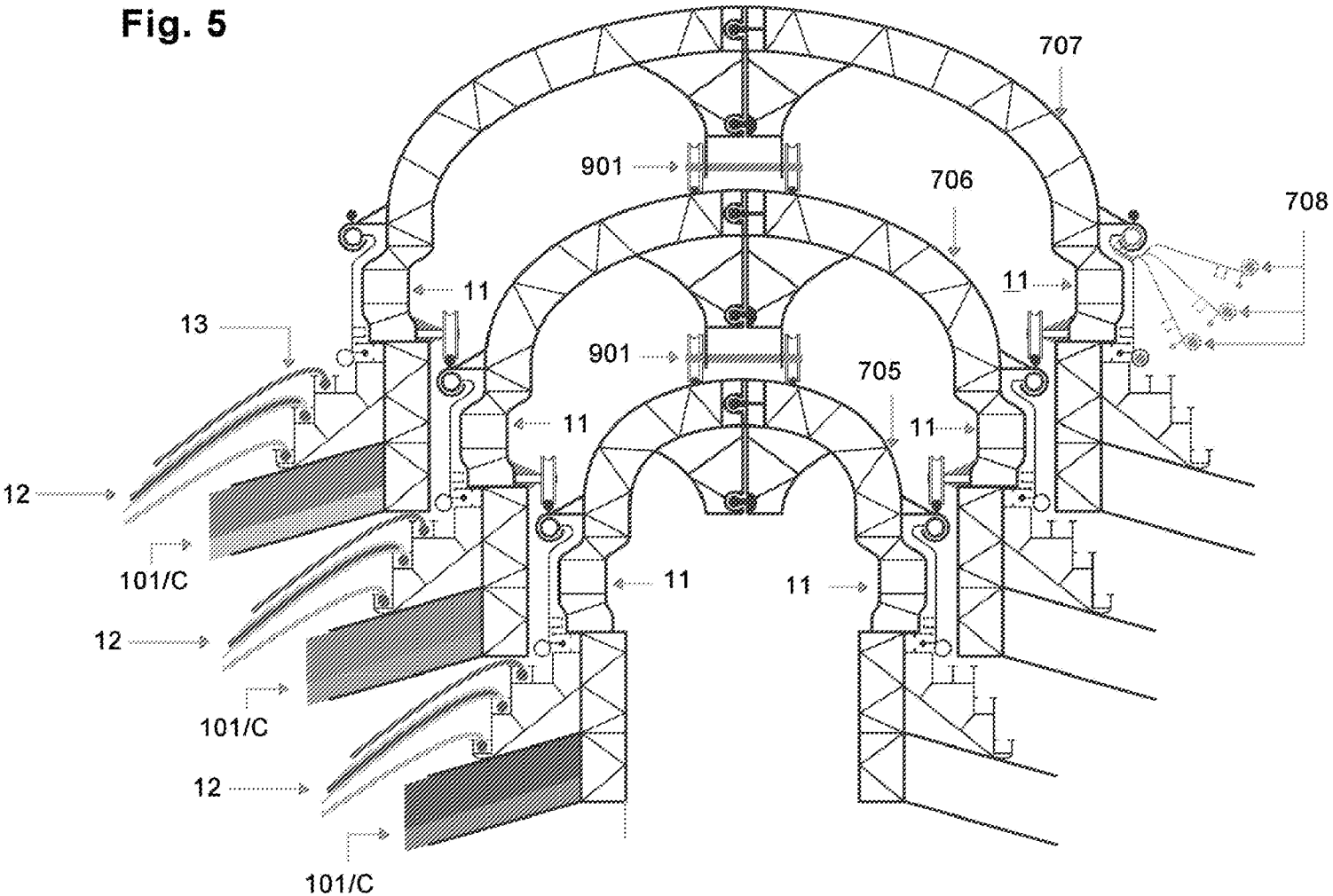
FIG. 5 shows, in cross section, the telescopic system used for the displacement of the upper part of the covering (the corresponding system for the lower part is similar but is omitted in the drawing)

In FIG. 5 (taken in combination with FIG. 1) it may be seen that at the top of the structure there is provided a plurality of Ω-shaped structural elements which are denoted by 705, 706, 707 respectively and which have different cross sections, all of which act as upper support beams of the structure and have the following functions:

a "telescopic function" based on their different sizes which allow a mutual "telescope-like" insertion;

an anti-wind function, due to the presence of holes 11 (which are shown in FIG. 1 whereas only their positions are indicated by 11 in FIG. 5); these lateral holes are present on the entire length of the structural elements 705, 706, 707, and by virtue of the longitudinal (shaped) elements 708 that can rotate (open or close) similar to butterfly valves, the strong gusts (that possibly enter the structure from its lower part) are allowed to exit (escape) from the inner space of the structure to the outside thereof, avoiding in this way the 'bulging effect' of the movable covering in case of a strong wind;

a support function with respect to the roof (covering); in fact, the various section bars 101/C (see FIG. 1) acting as supporting arches extend from both sides of the omega-shaped structural elements (note that although they are shown only on the left side in FIG. 5 the configuration is obviously mirror-like); moreover, these section bars 101/C extend up to the region of the "long" sides of the structure of the present invention, and in this region they are attached to longitudinal structural elements which act as trolleys and which will be discussed later on (see FIG. 6);

D) the function of seat 13 for several layers of cloth, or thin sheets of lead, sponge, or Dralon™ cloth, or Trevira™ cloth; these layers are schematically and globally indicated by reference numeral 12; it should be noted that in FIG. 5 each omega-shaped structural element 705, 706, 707 supports and transports during the displacement of the movable roof, a respective part of "cloth" 12 both on the left side (indicated in FIG. 5) and on the right side (not shown in FIG. 5 in order to simplify the drawing), and that these parts of "cloth" 12 are also supported by the arched structural elements 101/C;

E) the function of decorative and support structurals in case of beam structures with a long span of e.g. 14 meters, by acting as arcuate crosspieces coupled to the structural 701 (either directly or indirectly through the abovementioned movable structurals (trolleys), as will be described below);

F) the function of structural elements, used for the translation (displacement) of the upper part of the telescopic roof, by virtue of the grooved wheels 901 (see also reference 901 in FIG. 10) which prevent any derailment and which allow a mutual contact (between the Ω-shaped structural elements) and a perfect performance (operation) of the covering (telescopic roof). It should be noted that the "upper" Ω-shaped structural element 707 is obviously stationary, while the structural elements 706 and 705 are movable in order to generate the motion shown (schematically) in FIGS. 2, 3, 4.

When considering the transparent part, it should be borne in mind that one must imagine the telescopic system described above for the non-transparent part of the covering, to be "duplicated" and arranged below the non-transparent part.

However, in the case of the transparent covering, the numeral 12 will now indicate the transparent material used for this part of the covering.

Figure 6:
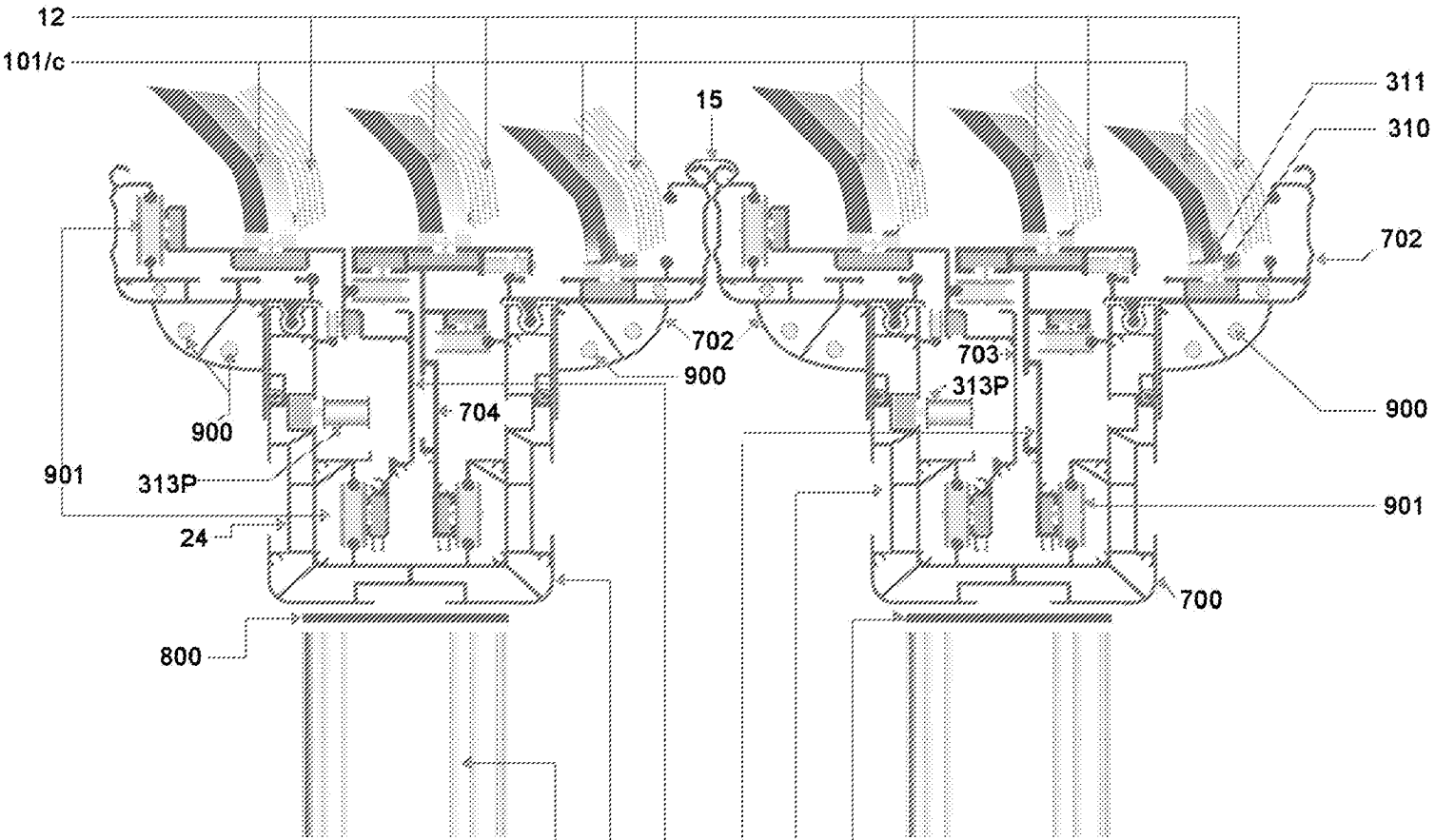
FIG. 6 is an orthogonal cross sectional view of a "long side" of the structure, that is, a cross section taken perpendicularly to the section bars which form said long side (either left or right) in FIG. 1.

Turning now our attention to FIG. 6, it shows a cross section of "the long right side" of the structure represented in FIG. 1. The long left side has a mirror-like configuration. The two parallel section bars 701 of the upright can be seen in this figure;

obviously, if the structure is quite long, the two parallel section bars 701 will be present several times also in the intermediate region of the horizontal and parallel section bars 700, and in this case, at the connection points 700/701 there will be provided gaskets/seals 800, formed by slices (thin sheets) whose plan view corresponds to the detail 800 shown in FIG. 10.

FIG. 6 shows three outermost, non-transparent parts 12, which are formed by several sheets joined to the outermost omega-shaped structural elements 705-707 (not shown in FIG. 6), and innermost parts 12 (that are preferably transparent), which are associated to the second, internal telescopic system consisting of a second group of inner structural elements 705, 706, 707 (not shown in FIG. 6).

By examining FIG. 6 from the right to the left, one notes first of all a structural element (section bar) 702, individually shown in FIG. 10, which is hooked by means of knob-shaped (in cross section) longitudinal ribs 14 to the first and outermost horizontal structural element (section bar) 700 (see also the view of the component 700 in FIG. 10). Moreover, structural elements (section bars) 703 and 704 acting as trolleys for the displacement of the elements 12 and 101/C are also included in this figure.

In the central part of FIG. 6 there are provided two further horizontal section bars 702 made of aluminium, which extend as well along the whole length of the structure and are stationary. The structural elements or section bars 702 have longitudinal hollow regions used for the passage of electric cables or the like, which are indicated by reference number 900. The section bar 702 located leftmost also extends along the whole length of the structure. Reference number 901 denotes special grooved wheels of the same kind as already mentioned with reference to FIG. 5.

Obviously, the structural elements (section bars) 703 and 704 do not obviously extend along the whole length of the structure, but only for the length required to cover the whole structure when the telescopic system has been completely "extended" or "expanded".

Note that the wheels 900 are of a particular kind, suited to resist to atmospheric conditions, since the meteoric water (e.g. rainwater or water due to melted snow) or the washing water (see below) or debris/waste can directly pass through the open upper part of the structural elements 700 and be collected by the (upwardly open) elements 308 which are used to collect and drain the water to the ground (see above). Finally, note that the two central section bars 702 are suitably coupled to each other—using means 15 which are shown in FIG. 6—to insure stability and waterproofing; otherwise, the water would fall into the structure when the upper, non-transparent covering is opened, while the lower transparent covering is left closed.

Summing up, the section bar 703 is a section bar made of aluminium which acts as a displacement trolley and which carries wheels such as 901; this trolley is coupled to the (stationary) section bars 702 and to the (movable) section bar 704, thus allowing the assembly of the telescopic roof to be displaced linearly back and forth.

Moreover, the component 704 also acts as a translating trolley that carries grooved wheels which engage with the structural elements 700-702-703 and in this way it permits a back-and-forth translation of the telescopic system of the structure according to the present invention.

The aluminium-made structural element 701 shown individually and in cross-section in FIG. 10 has many grooves and various functions; it has the function of support upright but also the function of support beam in those cases in which beams are to be constructed with a length reaching 14 meters without resorting to an intermediate upright. In other words, it may be coupled to a structural element (section bar) 700 in the longitudinal direction so as to act as a reinforcement beam; this connection in the longitudinal direction between the structural elements 700 and 701 is effected in the following way; the H-shaped connection member 320 shown in FIG. 9 acts like an "I-beam" (I-iron) and as a mutual connection element between the structural elements 701 and 700 after longitudinally inserting the two T-shaped heads 16 and 16' of the member 320 into the external slots or grooves 17 of the section bars 700 and 701 (FIG. 10).

Moreover, as has already been said above, another function of the section bar 701 is that of support upright and downpipe (drainage to the ground, from the roof, of meteoric waters but also of washing water).

Moreover, another function of the structural element (section bar) 701 is that of allowing the passage of electric cables through various slots, but also to act as support for illumination devices or electric heating lamps.

The section bar 702 is also an aluminium-made section bar with different functions, which is coupled to the structural element 700 in the manner described with reference to FIG. 6. The section bar 702 acts (see FIGS. 6 and 5) as support for the omega-shaped beams and for the arches or arcuate section bars 101/C.

In the following, a further mechanism will be described, acting as "subsystem" included in the global anti-wind system of the structure according to the present invention.

FIG. 8 shows fittings or accessories 310 and 311 formed by integral pieces of die-cast aluminium. The component 311 has a protrusion with square cross-section 19 to be introduced inside the central space 18 of the structural 101/C (see FIG. 10 and FIG. 6 on the right); at the same time, the component 310 is fixed on the side of its plate (smooth part without hinges) to the structural 702 (see FIG. 6 on the right). Then, after this assembling operation, the hinges of the components 310 and 311 are automatically arranged in facing positions, and an articulation pin (pivot) can then be inserted inside the hinges 20 in order to obtain a pivotal connection between these components 310 and 311. The assembling operation and connection just described between the components 310 and 311 is effected at appropriate intervals (distances), along the outermost structural 702 (on the right in FIG. 6) but also on one of the central structural elements 702 of FIG. 6, at adequate intervals (distances); moreover, although not shown to simplify the drawing in FIG. 6, identical hinged connections between the structurals 101/C and the structurals 703, 704 are provided on the structurals (trolleys) 703, 704 on the right and on the structurals (trolleys) 703, 704 on the left. Thus, in case of a strong wind the lower covering and/or the upper covering will be able to "rock" or "roll" to a certain degree, taking advantage of this "play" provided by the hinges, so as to insure, by virtue of this "controlled" or "calibrated" yielding, a greater resistance to gusts of the present structure.

As shown in FIG. 1, a plurality of stationary arcuate beams 22 are used to clean—by means of water jets generated from adequate holes—the outer side of the external covering (or the outer side of the internal covering if the external covering is in its open condition). The water used for washing is collected in the above described manner, passing along the horizontal, lateral structurals 700 and through the various components 308 and thereafter through the inner space of the uprights formed by the parallel and vertical section bars 701.

The stationary arcuate beams 22 are adequately fixed at their two ends to the "long sides" of the structure according to the invention and form the outermost components of the structure covering, insuring for instance—by acting as a sort of cage—the retention of the covering in case of a very strong wind.

The component 305 (FIG. 8) is formed by a shaped longitudinal element having a complex structure, made of EPDM or neoprene, and having the following functions:

it acts as a cleaning element of the upper part of the telescopic roof and it is connected to the structural 101/C (see FIG. 8 on the right upper corner and in FIG. 1 in particular the element 101/C located on the front part of the structure), where it is assumed that the layers of material 12' located on the left (in FIG. 8) are absent and that a respective seal 305 is inserted inside the recess 21, in the "upside down" orientation, with its base 22*a* inserted inside said recess 21, and moreover, that another seal is inserted inside the structurals 101" (FIG. 1) according to the orientation shown in FIG. 8 (not upside down). In this manner, when the roof is moved these seals 305 scrape and clean the covering and let the debris flow down, preventing in this manner their accumulation on the right side of the structure according to the invention, which is shown in FIG. 1;

it eliminates vibrations and reduces the noise generated by the telescopic roof, by eliminating the noise produced by the shaking and beating of adjacent parts of the structure, as caused—for instance—by the wind;

it acts as a seal avoiding draughts and penetration of dust and debris inside the telescopic roof;

it acts as a seal (barrier) against dust, air, water, in the shock absorber system.

In order to better explain the function and arrangement of the seal 305, consider again FIG. 8 and particularly the drawing shown at the right upper corner in this figure. This corresponds to an orthogonal cross-section of the covering, taken along a plane as indicated by the line A-A in FIG. 1.

It can be seen that the cross-section "cuts" the arcuate structural 101/C which supports the layers of the covering, wherein this movable structural 101/C is momentarily located (in this drawing) in an intermediate position between a couple of stationary arcuate beams 22. The recesses or grooves 21, 21' receive respective longitudinal stretches of covering and therefore the arcuate structural 101/C acts as a support means and a joint in the longitudinal direction between two adjacent stretches or portions of the multilayer covering. The various structural elements must be imagined to be evenly distributed at predefined distances along the internal covering and respectively along the external covering.

The (movable) structural element 101/C located (momentarily) in the drawing on the front side of the structure in FIG. 1 obviously supports the layers 12 of the covering on one side only, so that, referring to what has been said above and to FIG. 8 once again (part shown on the right upper corner), the seal or gasket 305 is inserted inside the longitudinal recess or groove 21 in an upside down orientation with respect to the orientation of FIG. 8, and it acts, in place of the layers 12 of the covering, as an element which prevents the water and the debris from falling on the front side of the structure, or in general inside the structure—depending on the position momentarily occupied by the telescopic roof—.

As already described, the structure according to the present invention includes an aseismatic system which allows oscillations of the structure in response to earthquake waves. To control the maximum degree of oscillation or "rolling" of the structure, there are provided components 329, 330, 331 which are shown in FIG. 10 on the right lower corner of the sheet. The component 329 is formed by an integral piece of die-cast aluminium presenting a circular seat for a ball-and-socket joint rotatable by 360° and which is coupled to the component 330; the latter can rotate by 360° along a groove and it can, if necessary, be locked by means of three radial bolts.

The component 330 is an integral piece of die-cast aluminium with variable cross section and with slots (grooves) allowing a 360° rotation; it is coupled on one side to said component 329 and on the other to the component 331; the latter, as shown in FIG. 10, acts as an articulated joint for an angle of 35° and permits, due to its coupling to the component 330, a rotation in all directions, while acting at the same time as a stabiliser of the structure, as will be explained next.

Thus, for the purpose of limiting the oscillations of the structure, on the upper side of the same several elements 331 are interconnected and form a reticular structure or simply a rigid "X-shaped" structure which spans in the transversal and longitudinal directions the upper, inner part of the structure; moreover, the lateral outermost parts or ends of the various elements 331 forming the reticular structure are inserted, by means of the lower plates 23 of their respective components 329, inside the groove-like seats 24 of the lateral, horizontal structurals (section bars) 700, on the side facing the inner space of the structure (see also FIG. 10). In this manner, the rotation—restricted to 35°—of the articulated joint 330-331 allows to limit the oscillation (rocking) of the structure in the eventuality of hurricanes or violent earthquakes. This is obviously a guarantee of safety for the people inside the structure.

Considering again the configuration of the covering, preferably the internal covering will be made of transparent material and the external covering will form a plurality of non-transparent layers 12. However, it should be noted once again that this illustrative configuration is not binding, and that also the internal covering could consist of a multilayer structure 12 (see for instance the purely illustrative and non-binding FIG. 6 in which it can be noted that the double telescopic system for the displacement of the (internal ant external) parts of the covering only comprises multiple layers 12 of the "same", that is, non-transparent type).

The layers 12, 12' may for example consist of various layers, in the following manner:

First layer: high-resistance PVC cloth (upper part) suited to resist to the rain and the snow;

Second layer: PVC cloth with spongy mousse acting as an insulating material, protecting from the heat and the cold weather;

Third layer: sheet of cork used as partial soundproofing and as heat insulation material;

Fourth layer: cork-made layer or trevira CS layer, used for obtaining a heat insulation or a refinement of the internal space of the structure, and for improving the comfort of the people which are momentarily staying under the telescopic roof of the structure according to the present invention.

Before describing the drive system of the four trolleys 703, 704, 703, 704 associated with the two coverings (upper and lower covering), we return to a description of the seals and in particular to FIG. 10 which shows the gaskets or seals 800 and 801. If the structurals 700 and 701 are rather long and include various parts, in the butt joints between one part and the next adjacent part, it is possible to insert planar seals 800 and 801 whose cross-section (in the plane defined by the seal) is a "copy" of the configuration of the cross-section of the structural elements 701 and 700 respectively, as can be inferred from FIG. 8.

Next, we will describe the drive system for the telescopic coverings ("telescopic roofs").

Figure 9:
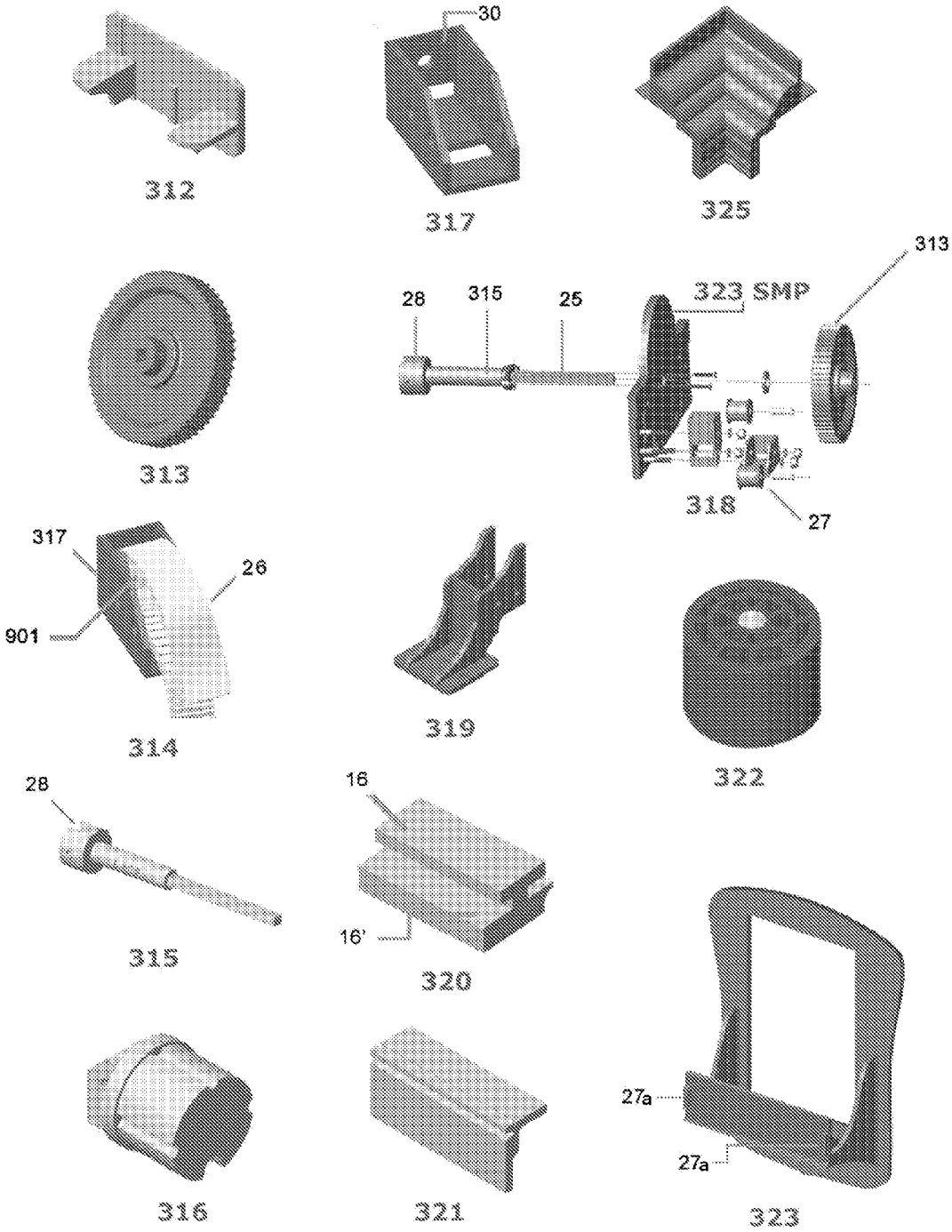
FIG. 9 shows several components or fittings of the structure according to the present invention, in particular those used to drive the upper and the lower parts of the covering.

FIG. 9 shows—see assembly 318—an exploded view of the various components which form the drive system used for linearly displacing the movable structurals or trolleys 703, 704 which in turn support the movable parts of the telescopic roofs.

Reference numeral 315 (also shown individually in FIG. 9) denotes a coupling for a driving shaft; 313 denotes a gearwheel set in rotation by the coupling 315 whose terminal, stem-like portion 25 (with square cross-section) transmits the power from the motor (not shown) to the gearwheel 313; 317 indicates the "box" of the belt tensioner (or simply the tensioner) used to stretch the timing belt 26 shown wound (see reference 314) around and within the groove of a pulley of the kind 901 mounted inside the tensioner 317; 27 generally indicates small transmission pulleys; 323 denotes a shell used to receive and mount the motor, this shell being provided with two lateral projections 27*a* allowing to mount the motor on the structural 700; 328 (FIG. 10) denotes once again the driving shaft together with its length adjustment system used to adapt the length of the drive shaft (or drive shaft coupling) 315 to the distance (spacing) that separates the two gearwheels 313 located on opposite "long" sides of the structure represented in FIG. 1. In practice this adjustment is performed by transversally inserting between the two pulleys 313 the extension 316, which in turn is inserted into apposite notches 28, at the ends of the couplings 315 opposite to the position of the gearwheels 313.

Specifically, the coupling 315 is formed by an integral piece of die-cast aluminium incorporating a high-resistance and torsion-resistant square bar 25 and acting as drive shaft.

The component 316 used for the adjustment, which is transversally inserted between two couplings 315 located on opposite sides of the structure and having a predetermined mutual distance in a specific case, but which varies according to the structure size, acts as an extension of the drive shaft, or better, as an extension member of the two couplings 315.

The detail 328 (FIG. 10) shows the extension member 316 connected to only one coupling 315, but connectable to the other coupling 315 (not shown) at its free end 29.

The tensioner 317 acts as a motion transmission element for the timing belt and is mounted on the front part of the structure. Its position is adjustable by means of a bolt to be inserted into the hole 30 (FIG. 9).

The abovementioned component 323 is formed of an integral casting of aluminium, configured like a shell and serving as a motor support, to be coupled to the horizontal structural 700 by means of the projections 27*a* which in turn engage the groove 31 (see also FIG. 6). This system allows to fix the motor (not shown) with a perfect axial orientation of the drive shaft.

The motor may for instance be of the type Somfy Compact 400 NW.

The abovementioned component (gearwheel) 313 is formed of an integral piece of die-cast aluminium of circular form acting at the same time as a driving and guiding means for the belt and allowing a back-and-forth translation of the respective telescopic roof taking advantage of the power provided by the abovementioned (three-phase) electric motor.

The component 314 includes the abovementioned belt 26 (used to transmit the motion to one of the "trolleys" 703), this belt being formed for instance of steel-strand reinforced polyurethane (Type AT 10 25). The timing belt 26 is obviously adapted to the toothed contour of the gearwheel 313.

The component 321 (see FIG. 9) is included as well in the drive system of the double telescopic roof making part of the structure according to the present invention.

The component 321 is an integral piece of die-cast aluminium and it serves as a connection means between the trolley 703 and the timing belt 26; in substance, the toothed belt 26 is connected and clamped with bolts (not shown) between the component 321 and the respective structural 703 while the latter transmits the motion, in turn, to the structural 704. Actually, by suitable means whose description will be omitted, the trolley 703 drags the other trolley 704 both during the closing and the opening of the (lower/upper) telescopic covering.

The drive system described herein in general terms includes two transmission pulleys 313P (FIG. 6) fixedly mounted, on the front part of the structure shown in FIG. 1, within their respective tensioners 317 (see also 314 in FIG. 9), the latter being fixed to the corresponding structurals 700 (FIG. 6). Therefore, the belts move within and along the longitudinal cavities formed by the structurals 700, dragging in one direction or in the opposite direction the trolleys 703 and 704 of the respective telescopic roof (depending on the rotational direction of the respective motor), each telescopic roof being obviously driven independently of the other. Therefore, two separate motors are provided, each of them being associated with a corresponding timing belt driven on the right side of the structure, or stated differently, with a corresponding timing belt driven on the left side of the structure. Thus, another pair of timing belts is present on the other "long side" of the structure which faces the former long side (shown in FIG. 6) and which has a mirror like configuration with respect to it.

The timing belts 26 located on the opposite side of the structure shown in FIG. 1, inside the respective structurals 700, receive the power necessary for their motion by means of the respective drive shaft, the associated extension member, and the respective coupling 315 arranged on the opposite side; the latter coupling causes the rotation of the corresponding driving gearwheel 313 around which the corresponding timing belt 26 is partially wound. Each of the two "drive shafts" therefore extends from one side to the opposite side of the structure and serves to rotate respective, opposite gearwheels 313 arranged at opposite ends of the "drive shaft". In all, there are two parallel "drive shafts" extending transversally through the structure, two respective driving motors (for driving the drive shafts) mounted in a staggered manner within the structure and on the structurals 700, four transmission pulleys 313P (two on either side of the structure) arranged on the front part of the structure and mounted inside the structurals 700 (see FIG. 6), and four gearwheels 313 (two on either side) driven in pairs by the drive shafts and mounted on the rearmost part of the structure.

Other details of minor importance of this embodiment relate to the components 309, 312 and 325.

The component 309 is a front closure plate for the structurals shown in FIG. 6 (in fact it may be seen that this plate has a contour identical to that of the structurals).

The component 312 is a piece of die-cast aluminium acting as a tension adapter (tension regulator) for the various kinds of cloths employed in the coverings of the structure and it is coupled to the structural 101/C.

The present invention has obviously been described only for illustrative and non-limitative purposes, therefore it is not intended limited to the present embodiment.

Moreover, walls can obviously be provided in combination with windows, doors, or other passages, if necessary. It goes without saying that if this structure is realised for an outdoor swimming pool such means are unnecessary, but a non-transparent covering could be required, for instance, for preventing sunstrokes to the customers.

Among the various advantages of the present invention we can mention the following ones:

it can be used as a covering in windy places;

it is useful as a transparent covering in very cold places with modest insolation ("greenhouse effect");

it is useful because its covering system has a protective action against cold and hot weather;

it is useful because it has a double telescopic covering that can be opened or closed;

it is useful in desert lands or in zones with high amounts of dust-sand-debris (since it is provided with a roof-washing system and with a movable system with "self-cleaning" seals or "automatic-scraping" seals);

it is useful in seismic zones;

it is useful for large exhibitions and/or meetings or the like, due to the refinement/elegance of the internal layer included in the multilayer structure 12;

it is of extreme usefulness because of its modularity, since it can be rapidly assembled and disassembled, and because it can be adapted to various requirements, e.g. space optimisation requirements;

it is advantageous because it insures the safety of the people momentarily staying under the structure;

it is advantageous because it has a light roof which at the same time can resist to the weight of the snow and which is soundproofed—for instance in case of rain or hail—.

Moreover, it is provided with a system which automatically cleans the roof by eliminating the debris/dirt and which allows the automatic drainage/downflow of the washing water and the meteoric water. Moreover the roof can also be made cooler by actuating the water jets. The sizes of the components (for instance of the structural elements 700) have been appropriately designed to optimise the lightness, the resistance and the dimensions, without modifying the required function/performance; this means—in the case of the structurals 700—a maximum reduction of their transversal size, taking account at the same time of the necessity of: withstanding both static and dynamic loads; the requirement of arranging, within these components, the various trolleys, the pulleys, the belts; insuring the presence of a sufficient space for the downflow/drainage of the water (see above).

The present embodiment can obviously be modified in various ways by a skilled person without departing from the scope and protection conferred to the present invention and without modifying its basic inventive concept.

The invention claimed is:

1. A aseismatic structure usable as a covering, comprising:

horizontal support beams (101', 700);

a plurality of uprights (701, 701), each upright having a base, connected to the horizontal support beams (101', 700) at respective interconnection regions between said uprights (701, 701) and the horizontal support beams (101', 700);

telescopic coverings being supported by the uprights and the horizontal support beams, the covering being formed by several sections configured to be inserted into each other in telescopic-like fashion when the telescopic coverings is opened;

vibration preventing means (306; 307; 319) in the interconnection regions between said uprights (701, 701) and the support beams (101', 700) and at the bases of the uprights (701, 701), the vibration preventing means configured to allow an oscillation of the structure in all directions; and anti-wind means comprised of:

rotatable structurals (708) configured to open and close apertures (11) in the telescopic coverings in response to strong gusts of wind so that said strong gusts escape from an inner space of the structure; and rotation means (310, 311) inserted between a lateral edge of at least one of the telescopic coverings and the lateral structurals configured such that a strong wind will cause a transversal rolling movement of the structure such that the telescopic coverings yield in response to gusts of the wind.

2. The structure according to claim 1, wherein a first subset (703, 704) of said lateral structurals (702, 703, 704) are movable and are received inside the horizontal support beams (700) and form trolleys configured to support and displace said sections of the telescopic coverings, wherein a second subset (702) of lateral structurals are stationary and extend along a whole length of the structure.

3. The structure according to claim 1, further comprising:

means (329, 330, 331) for restricting an angle of absolute oscillation of the uprights relative to a base plane defined by the telescopic coverings.

4. The structure according to claim 1, wherein at least one of the telescopic coverings is made of transparent material.

5. A aseismatic structure usable as a covering, comprising:

horizontal support beams (101', 700);

a plurality of uprights (701, 701), each upright having a base, connected to the horizontal support beams (101', 700) at respective interconnection regions between said uprights (701, 701) and the horizontal support beams (101', 700);

telescopic coverings being supported by the uprights and the horizontal support beams, the covering being formed by several sections configured to be inserted into each other in telescopic-like fashion when the telescopic coverings is opened;

vibration preventing means (306; 307; 319) in the interconnection regions between said uprights (701, 701) and the support beams (101', 700) and at the bases of the uprights (701, 701), the vibration preventing means configured to allow an oscillation of the structure in all directions;

drainage and guiding means for draining and guiding water from the telescopic coverings to the ground, said drainage and guiding means including:

first longitudinal channels inside the support beams (700) upwardly open and configured for downflow of the water from the telescopic coverings to the uprights (701, 701);

second longitudinal channels formed inside the uprights (701, 701), leading to plates (1, 2) located at the base of each upright (701, 701) where some (307) of said vibration preventing means (306; 307; 319) are also located.

6. The structure according to claim 5, further comprising:

means (329, 330, 331) for restricting an angle of absolute oscillation of the uprights relative to a base plane defined by the telescopic coverings.

7. The structure according to claim 5, wherein at least one of the telescopic coverings is made of transparent material.

8. A aseismatic structure usable as a covering, comprising:

horizontal support beams (101', 700);

a plurality of uprights (701, 701), each upright having a base, connected to the horizontal support beams (101', 700) at respective interconnection regions between said uprights (701, 701) and the horizontal support beams (101', 700);

telescopic coverings being supported by the uprights and the horizontal support beams, the covering being formed by several sections configured to be inserted into each other in telescopic-like fashion when the telescopic coverings is opened;

vibration preventing means (306; 307; 319) in the interconnection regions between said uprights (701, 701) and the support beams (101', 700) and at the bases of the uprights (701, 701), the vibration preventing means configured to allow an oscillation of the structure in all directions; and stationary arcuate beams (22) configured to contain a whole upper portion of the telescopic coverings, said stationary arcuate beams (22) including channels for receiving pressurised water to be sprayed on the telescopic coverings for cleaning.

9. The structure according to claim 8, further comprising:

gaskets/seals (305) on a lower arcuate side (101") of said stationary arcuate beams (22) configured to perform a scraping action on the surface of the telescopic coverings for cleaning dirt/debris during a movement of the telescopic coverings.

10. The structure according to claim 8, further comprising:

means (329, 330, 331) for restricting an angle of absolute oscillation of the uprights relative to a base plane defined by the telescopic coverings.

11. The structure according to claim 8, wherein at least one of the telescopic coverings is made of transparent material.

12. A aseismatic structure usable as a covering, comprising:

horizontal support beams (101', 700);

a plurality of uprights (701, 701), each upright having a base, connected to the horizontal support beams (101', 700) at respective interconnection regions between said uprights (701, 701) and the horizontal support beams (101', 700);

telescopic coverings being supported by the uprights and the horizontal support beams, the covering being formed by several sections configured to be inserted into each other in telescopic-like fashion when the telescopic coverings is opened; and vibration preventing means (306; 307; 319) in the interconnection regions between said uprights (701, 701) and the support beams (101', 700) and at the bases of the uprights (701, 701), the vibration preventing means configured to allow an oscillation of the structure in all directions, wherein said vibration preventing means located at the bases of the uprights (701, 701) comprise shock absorbers (307) including a pair of arcuate leaf springs of high-quality high-carbon steel in connection with a shaped body of EPDM, and also including helical springs interposed between said arcuate leaf springs, and further including a plane base of stainless steel, said shock absorbers (307) being evenly distributed at the base of each upright in order to allow oscillations of the respective upright (701, 701) for enabling the uprights to oscillate in all directions.

13. The structure according to claim 12, further comprising:

means (329, 330, 331) for restricting an angle of absolute oscillation of the uprights relative to a base plane defined by the telescopic coverings.

14. The structure according to claim 12, wherein at least one of the telescopic coverings is made of transparent material.

15. A aseismatic structure usable as a covering, comprising:

horizontal support beams (101', 700);

a plurality of uprights (701, 701), each upright having a base, connected to the horizontal support beams (101', 700) at respective interconnection regions between said uprights (701, 701) and the horizontal support beams (101', 700);

telescopic coverings being supported by the uprights and the horizontal support beams, the covering being formed by several sections configured to be inserted into each other in telescopic-like fashion when the telescopic coverings is opened; and vibration preventing means (306; 307; 319) in the interconnection regions between said uprights (701, 701) and the support beams (101', 700) and at the bases of the uprights (701, 701), the vibration preventing means configured to allow an oscillation of the structure in all directions, wherein the vibration preventing means at the interconnection regions between the uprights (701, 701) and the support beams (101', 700) comprise:

a first component (306), comprising three pieces of die-cast aluminium forming together a triangle and an arc of a circle of 90°, and at least one internal spring (10) allowing the compression and expansion of two of the three pieces;

a second component (319), comprising a flat plate of aluminium surmounted by a double capital with an articulation joint, the second component also configured to direct water towards inner channels of the uprights (701, 701).

16. The structure according to claim 15, further comprising:

means (329, 330, 331) for restricting an angle of absolute oscillation of the uprights relative to a base plane defined by the telescopic coverings.

17. The structure according to claim 15, wherein at least one of the telescopic coverings is made of transparent material.

18. A aseismatic structure usable as a covering, comprising:

horizontal support beams (101', 700);

a plurality of uprights (701, 701), each upright having a base, connected to the horizontal support beams (101', 700) at respective interconnection regions between said uprights (701, 701) and the horizontal support beams (101', 700);

telescopic coverings being supported by the uprights and the horizontal support beams, the covering being formed by several sections configured to be inserted into each other in telescopic-like fashion when the telescopic coverings is opened; and vibration preventing means (306; 307; 319) in the interconnection regions between said uprights (701, 701) and the support beams (101', 700) and at the bases of the uprights (701, 701), the vibration preventing means configured to allow an oscillation of the structure in all directions, wherein the horizontal support beams comprise:

timing belts internal to the support beams and configured to drive any of movable trolleys and structurals associated with each of the telescopic coverings; and gearwheels (313) internal to the support beams, for directly transmitting a motion transmitted by a driving shaft (315, 316), transmission pulleys (313P), and belt tensioners (317).

19. The structure according to claim 18, further comprising:

means (329, 330, 331) for restricting an angle of absolute oscillation of the uprights relative to a base plane defined by the telescopic coverings.

20. The structure according to claim 18, wherein at least one of the telescopic coverings is made of transparent material.

* * * * *